US005660342A

United States Patent [19]

Bock

[11] Patent Number: 5,660,342

[45] Date of Patent: Aug. 26, 1997

[54] MIXING DEVICE

[76] Inventor: Gabriele Bock, Im Hoellchen 5, 64295 Darmstadt, Germany

[21] Appl. No.: 615,029

[22] Filed: Mar. 13, 1996

[30] Foreign Application Priority Data

Mar. 15, 1995 [DE] Germany ..... 195 09 390.9

[51] Int. Cl.[6] ..... B02C 19/08

[52] U.S. Cl. ..... 241/100; 241/169.2; 241/DIG. 27

[58] Field of Search ..... 241/100, 169.1, 241/169.2, DIG. 27, 199

[56] References Cited

U.S. PATENT DOCUMENTS

| | | | |
|---|---|---|---|
| 2,726,816 | 12/1955 | Brantley | 241/169.2 |
| 2,892,595 | 6/1959 | Tupper | 241/169.1 |
| 3,124,313 | 3/1964 | Kraus | 241/DIG. 27 X |
| 4,212,430 | 7/1980 | Dale | 241/100 X |
| 4,280,666 | 7/1981 | Jones | 241/169.1 |
| 4,366,930 | 1/1983 | Trombetti, Jr. | 241/169 |
| 4,714,205 | 12/1987 | Steinko | 241/95 |
| 4,765,549 | 8/1988 | Sherman | 241/169 |
| 5,322,227 | 6/1994 | Fiocchi | 241/100 |
| 5,533,683 | 7/1996 | Fay et al. | 241/169 |
| 5,553,793 | 9/1996 | Klearman et al. | 241/30 |

FOREIGN PATENT DOCUMENTS 0573781 6/1993 European Pat. Off. .

*Primary Examiner*—John M. Husar

[57] ABSTRACT

The mixing device for mixing a liquid with a dry material, particularly a bleaching agent, includes a mixing container (1) for the liquid having a top edge and a screw thread on which a threaded cap (5) can engage to close the mixing container and a receiving insert (7) located between the top edge of the mixing container (1) and the threaded cap (5). The receiving insert (7) includes an insert top member (8) and an insert bottom member (9). The insert bottom member (8) is provided with tablet receptacles (12) for tablets of the dry material and throughgoing openings (14) connecting each tablet receptacle (12) with the interior of the mixing container (1). The insert top member (9) is provided with comminuting pins (16) projecting into the tablet receptacles (12) of the insert bottom member (9) so that tablets in the tablet receptacles can be smashed and the broken pieces delivered to the interior of the mixing container when the threaded cap is screwed sufficiently tightly to the mixing container.

9 Claims, 2 Drawing Sheets

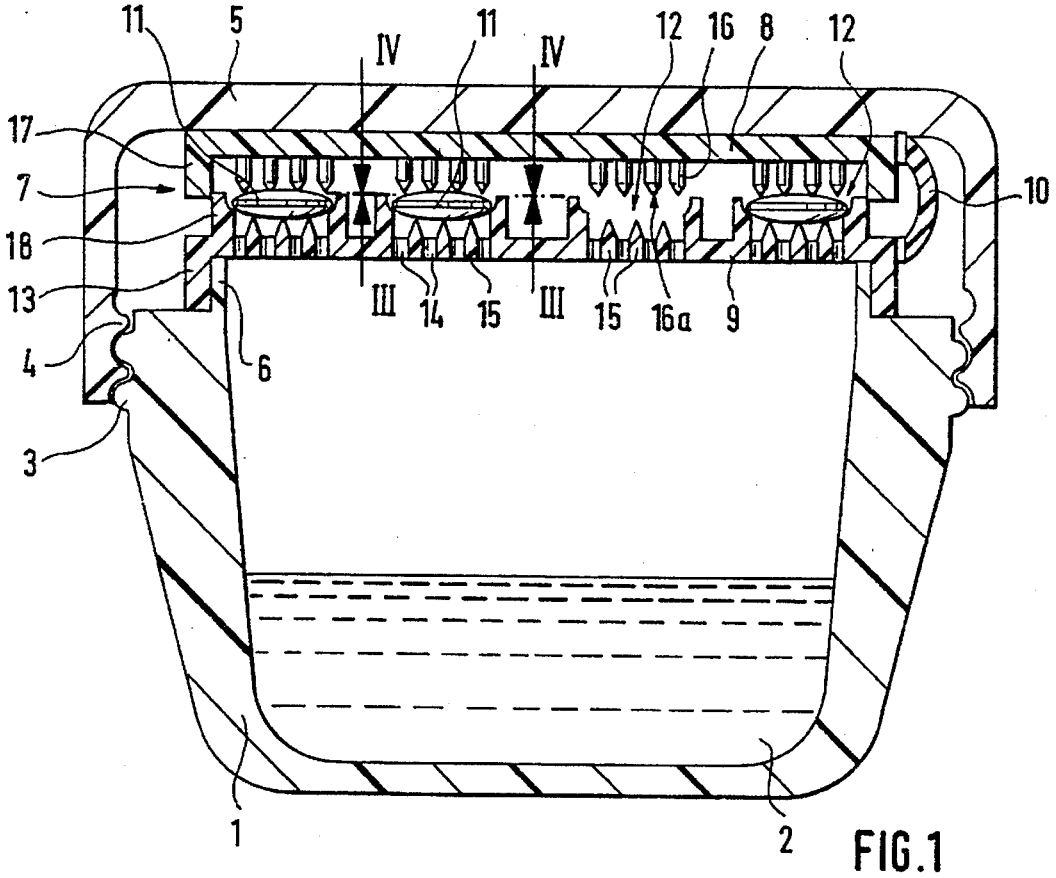
FIG.1
FIG.2
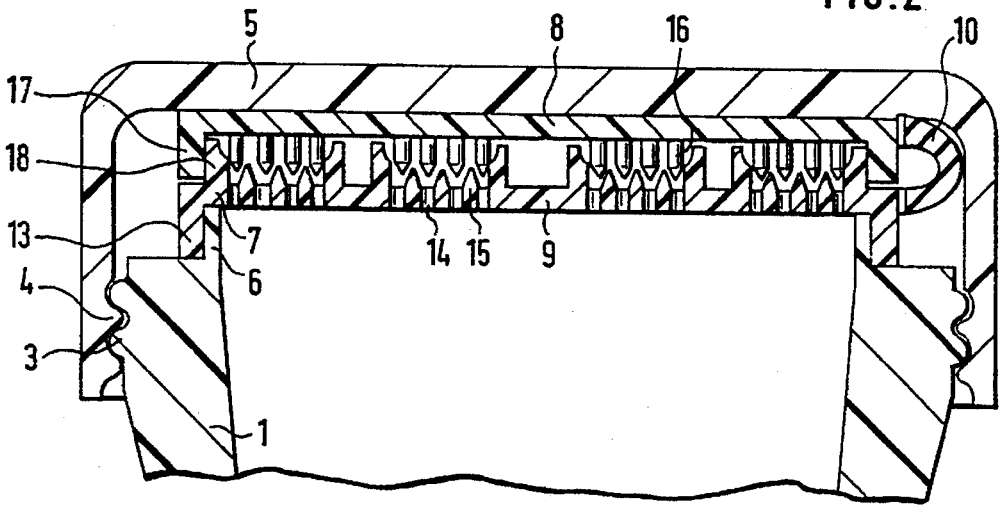

MIXING DEVICE

BACKGROUND OF THE INVENTION

The present invention relates to a mixing device for mixing a liquid with a dry material, which comprises a mixing container for receiving the liquid provided with a screw thread, a threaded cap and a receiving insert for receiving the dry material between a top edge of the mixing container and the threaded cap prior to mixing.

There is a danger of dust formation during mixing of a liquid with the dry material, usually present as a powder or granulate. This leads to contamination of the environment and can cause harm or be troublesome to individuals performing the mixing process.

A typical example of this type of mixing process is the admixing of bleaching agent in the professional hair styling business. A bleaching granulate is taken from a flask in a measured quantity and fed to a stirring vessel. If the bleaching agent is present in the form of a bleaching powder, it is taken from a package by means of a measuring spoon and delivered to a stirring vessel. Prior to that or after that, a measured amount of a liquid is delivered to the stirring vessel with a measuring beaker. The liquid and the dry material are mixed with a brush to obtain a creamy mass.

The measuring of bleaching granulate or bleaching powder by a measuring spoon and/or a measuring cap is considerably inaccurate, so that frequently liquid or dry material must be added later to obtain the desired consistency. The open handling of the dry material in the form of a bleaching powder or bleaching granulate leads to undesirable dust generation.

To avoid open handling of the dry material with associated dust generation and to avoid the measurement inaccuracies—at least for the dry material, a receiving insert is used for receiving the dry material in a known mixing device of the foregoing type (European Patent Application EP 0 573 781 A1), which is inserted between the top edge of the mixing container and the threaded cap. In this known mixing device the receiving insert comprises an inserted container containing the dry material, whose wall facing the mixing container is torn off on screwing on the threaded cap, i.e. in the already closed state of the mixing container torn off by an upwardly protruding pin on the edge of the mixing container, so that the dry material pours out from the inserted container into the mixing container and can be intensively mixed with the liquid contained therein by agitation.

Dust generation is thereby prevented; however no individual measurement of the amount admixed in is possible, since the entire contents of the inserted container must be mixed. However very different amounts of bleaching agents are immediately required during mixing of the bleaching agent in different individual cases according to the amount of hair to be bleached.

A simple and reliable measurement of the dry material while avoiding dust generation in sufficiently few steps could consist in preparing the dry material in the form of tablets and feeding the required number of tablets to the mixing container before it is closed. A complete dissolution of the tablets in the liquid to obtain a homogeneous, user-friendly mass however is not guaranteed, because, on the one hand, the surface areas on the tables wet by the liquid are small in comparison to their mass, so that the dissolving process can proceed only slowly and because of that, among other things, in a closed mixing container—even if the container is made of a transparent material—there is insufficient control when the dissolving process is completely finished. In practice this possibility can be realized only when tablets are used as the dry material and mechanically comminuted in a mortar-like device to accelerate the subsequent dissolving process. This comminuting would however still be connected with an associated dust generation.

SUMMARY OF THE INVENTION

It is an object of the invention to provide a mixing device of the above-described type with which a simple and accurate individual measurement of the dry material is possible while maintaining a dust-free mixing and a sufficiently rapid dissolving of the dry material in the liquid.

According to the invention the receiving insert comprises an insert bottom member and an insert top member. The insert bottom member has a plurality of tablet receptacles and is provided with at least one throughgoing opening connecting each of the tablet receptacles with the mixing container, while the insert top member includes a plurality of comminuting elements protruding into each of the tablet receptacles of the insert bottom member.

With the mixing device according to the invention for the first time it is possible to benefit from the advantages of a preparation of the dry material in tablet form. A predetermined amount of dry material may be measured out by providing different numbers of tablet receptacles of the insert bottom member with tablets. The disadvantage of considerably delayed dissolving connected with addition of dry material in tablet form to a liquid is effectively overcome because the tablets are comminuted in the tablet receptacles by comminuting elements before they drop through the throughgoing openings into the mixing container. The residue of the tablets remaining in the tablet receptacles is washed out and/or dissolved in subsequent mixing process in which the mixing device is shaken.

Dust generation is completely avoided because the comminuting of the tablets occurs first after the closing of the mixing container so that dust cannot be generated.

A receiving insert for receiving the dry material, which must be discarded after the emptying and mixing, is no longer necessary. The receiving insert can be cleaned after each mixing process and used again.

Accordingly in an advantageous embodiment of the invention each comminuting element is a pin is directed at a throughgoing passage or opening in the insert bottom member. Because of that a particularly effective smashing of the tablets occurs. It has proven particularly advantageous to provide several throughgoing openings for each tablet receptacle. The tablets are ground into a granulate having a predetermined grain size by the comminuting pins pointing at these throughgoing openings. Because of that, the dissolving process is accelerated and, at the same time, it is guaranteed that no individual broken pieces of the tablets substantially delaying the dissolving process remain.

The insert top member is advantageously hingedly or pivotally connected with the insert bottom member by a joint which advantageously can be an elastic hinge. Because of that both parts of the receiving insert are held together and simultaneously a sufficient centering of both these parts with each other is guaranteed.

In a preferred embodiment of the invention the insert bottom member is provided with grid cross members separating the throughgoing openings from each other and the grid cross members have grid edges directed into the tablet receptacle. In another embodiment the comminuting pins are each provided with a pin tip pointing into a tablet receptacle.

Advantageously means for centering the receiving insert on the mixing container are provided.

BRIEF DESCRIPTION OF THE DRAWING

The objects, features and advantages of the present invention will now be illustrated in more detail by the following detailed description, reference being made to the accompanying drawing in which:

FIG. 1 is a vertical cross-sectional view of a mixing device according to the invention for mixing liquid with a dry material prior to comminuting of the dry material in tablet form;

FIG. 2 is a cutaway cross-sectional view of the mixing device of FIG. 1 shown after the comminuting of the tablets.

DESCRIPTION OF THE PREFERRED EMBODIMENTS

Figure 3:
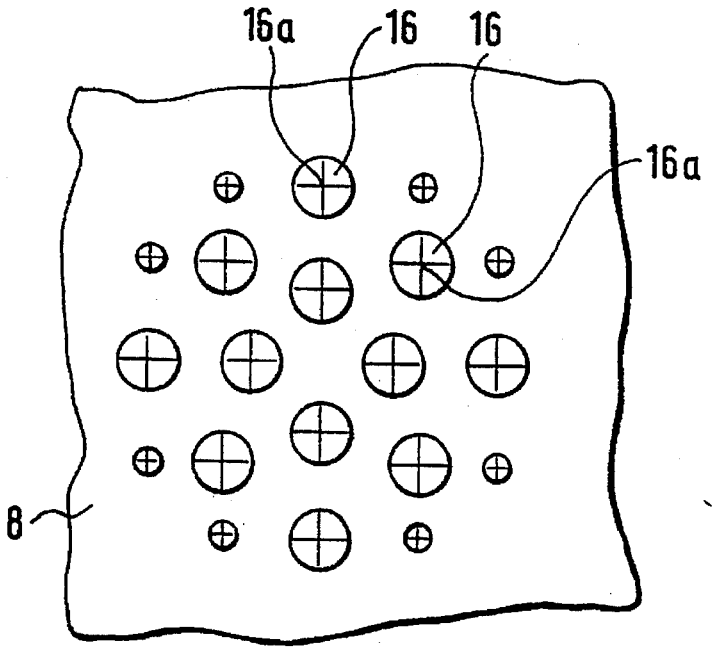
FIG. 3 is a detailed plan view of a portion of the insert top member in the direction of the arrows III—III in FIG. 1.

The mixing device shown in the drawing is used in a hair styling operation for mixing of bleaching agents. An activator liquid 2 is contained in a measured amount in a cup-like mixing container 1. The mixing container 1 has an exterior screw thread 3, on which a threaded cap 5 with an interior screw thread 4 can be screwed on in order to tightly close the mixing container 1.

A receiving insert 7 is arranged between the top edge of the mixing container 1, which is provided with a circular shoulder 6, and the interior surface of the threaded cap 5. The receiving insert 7 comprises a insert top member 8 and an insert bottom member 9, which are pivotally connected with each other by an elastic hinge 10 acting as a joint.

The dry material to be mixed with the liquid 2 is in the form of tablets 11. The insert bottom member 9 has several tablet receptacles 12, in some of which a tablet 11 is received. As one sees from FIG. 1, all tablet receptacles 12 are not provided with a tablet 11. The amount of the material to be mixed with the liquid 2 is determined by the number of tablets 11, which are deposited in the tablet receptacles 12.

The insert bottom member 9 is centered on the mixing container 1 by a circumferential centering edge 13, which engages over the circular shoulder 6. A centering of the insert top member 8 on the insert bottom member 9 occurs by means of the hinge 10.

Figure 4:
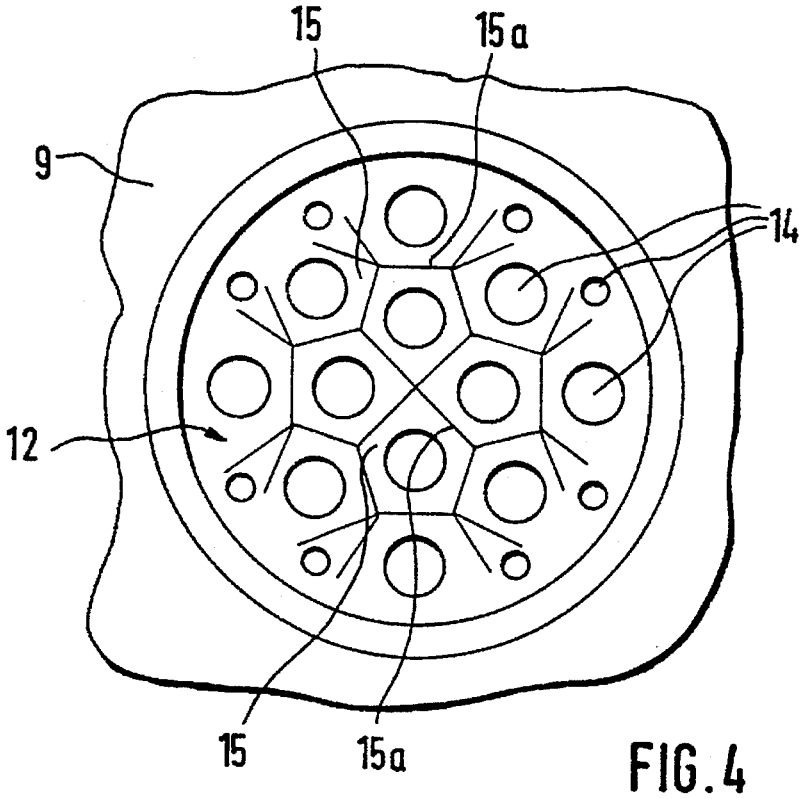
FIG. 4 is a detailed plan view of a portion of the insert bottom member in the direction of the arrows IV—IV.

Each tablet receptacle 12 has a plurality of throughgoing openings 14 opening into the mixing container 1, which are formed by round perforations or holes in the embodiment shown in the drawing, as seen from the detailed illustration in FIG. 4. The throughgoing openings 14 are separated from each other by grid cross members 15, which have a sharp cross-member edge 15*a* pointing into the tablet receptacle 12.

Comminuting pins 16 projecting into the tablet receptacles 12 are arranged in the insert top member 8. Each comminuting pin 16 is provided with a pin tip 16*a* pointing into the tablet receptacle 12 and at a throughgoing opening 14. This is seen particularly clearly by comparing FIGS. 3 and 4. The form and size of the tablet receptacles 12 and the prepared tablets 11 suitably conform to each other.

An appropriate number of tablets 11 are inserted in the tablet receptacles 12 according to the predetermined amount of dry material to be admixed. The insert top member 8 is shaped to fit together with the insert bottom member 9 so that the tablet receptacles 12 are already largely closed so that the tablets 11 will be prevented from falling out of the receiving insert.

A centering ring 17 projecting downwardly from the circumferential edge of the insert top member 8 engages over an upwardly projecting interior centering ring 18 from the edge of the insert bottom member 9. In this way the insert top member 8 and the insert bottom member 9 are centered with each other.

The receiving insert 7 thus prepared is placed on the edge of the mixing container 1, and the threaded cap 5 is screwed on and takes the position shown in FIG. 1 in which the mixing container 1 is already closed.

During further screwing of the threaded cap 5 on the container 1 the insert top member 8 is pressed against the insert bottom member 9. The tablets 11 contained in the tablet receptacles 12 are smashed by the comminuting pins 16. The broken pieces of the tablets 11 formed during the smashing drop through the throughgoing openings 14 in a grain size determined by the size of the throughgoing openings. The grains from the tablets are bound in the activator liquid 2 by shaking of the closed mixing device, whereby they can swell into a homogeneous mass. Subsequently the threaded cap 5 is unscrewed, the receiving insert taken out and cleaned. The bleaching material produced by the mixing process can be used directly from the open mixing container 1 acting as a vessel.

While the invention has been illustrated and described as embodied in a mixing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A mixing device for mixing a liquid with a dry material, said mixing device comprising a mixing container (1) for receiving the liquid to be mixed with the dry material, said mixing container having a top edge and a screw thread;

a threaded cap (5) for closing said mixing container (1); and a receiving insert (7) positionable between the top edge of the mixing container (1) and the threaded cap (5), said receiving insert (7) comprising an insert top member (8) and an insert bottom member (9), wherein said insert bottom member (8) is provided with a plurality of tablet receptacles (12) and at least one throughgoing opening (14) connecting each of said tablet receptacles (12) with said mixing container (1), and said insert top member (9) is provided with a plurality of comminuting elements projecting into the tablet receptacles (12) of the insert bottom member (9).

2. The mixing device as defined in claim 1, wherein each of said comminuting elements is a pin pointing at a throughgoing opening (14).

3. The mixing device as defined in claim 1, wherein each of the tablet receptacles (12) is provided with a plurality of the throughgoing openings (14).

4. The mixing device as defined in claim 3, wherein said insert bottom member (8) is provided with grid cross members (15) separating said throughgoing openings (14) from each other and said grid cross members (15) have grid edges (5*a*) directed into said tablet receptacle (12).

5. The mixing device as defined in claim 1, wherein said comminuting elements are each pins (16) provided with a pin tip (16*a*) pointing into a tablet receptacle (12).

6. The mixing device as defined in claim 1, further comprising means for centering said receiving insert (7) on the mixing container (1).

7. The mixing device as defined in claim 1, further comprising means for centering said insert top member (8) on said insert bottom member (9).

8. The mixing device as defined in claim 1, further comprising pivot means for pivotally connecting the insert top member (8) with the insert bottom member (9).

9. The mixing device as defined in claim 8, wherein said pivot means is an elastic hinge (10).

* * * * *